US005533346A

United States Patent [19]

Freeman et al.

[11] Patent Number: 5,533,346

[45] Date of Patent: Jul. 9, 1996

[54] HEAT PUMP AND METHOD

[75] Inventors: John O. Freeman, Killen, Ala.; Richard H. Howse, Morehead, Ky.; Tim Reinhart, French Lick, Ind.

[73] Assignee: Consolidated Technology Corp., Olive Hill, Ky.

[21] Appl. No.: 252,218

[22] Filed: Jun. 1, 1994

[51] Int. Cl.[6] ..... F25D 17/06

[52] U.S. Cl. ..... 62/89; 62/411; 62/296

[58] Field of Search ..... 62/89, 259.1, 324.1, 62/404, 410, 411, 419, 296, DIG. 16

[56] References Cited

U.S. PATENT DOCUMENTS

| | | | |
|---|---|---|---|
| 2,690,654 | 10/1954 | Graham | 62/419 |
| 2,817,217 | 12/1957 | Winkler et al. | 62/259.1 |
| 3,267,995 | 8/1966 | Maudlin | 62/259.1 |
| 3,939,506 | 2/1976 | Pearson | 4/213 |
| 4,420,036 | 12/1983 | Blaser | 165/45 |
| 4,554,796 | 11/1985 | Stankard | 62/326 |
| 5,271,292 | 12/1993 | Addington | 62/285 |

*Primary Examiner*—Henry A. Bennett
*Assistant Examiner*—William C. Doerrler

[57] ABSTRACT

A heat pump provides improved operating comfort, less noise and vibration by exhausting air upwardly with the use of a fan which is exterior of the heat pump housing. In one embodiment the fan is mounted on the roof and in another embodiment the exhaust fan is positioned in the attic.

15 Claims, 2 Drawing Sheets

HEAT PUMP AND METHOD

BACKGROUND OF THE INVENTION

1. Field of the Invention

The invention herein pertains to heat pumps for use in manufactured homes, office buildings and the like and particularly pertains to "inside" type heat pumps in which two condensor-evaporators are housed.

2. Description of the Prior Art and Objectives of the Invention

Heat pumps have been used for many years to condition interior environments of homes, office buildings, retail shops, manufactured homes and other buildings. In recent years a more compact heat pump utilizing a two compartment housing with each compartment containing a condensor-evaporator have been employed. This "inside" type heat pump generally includes an upper compartment having a condensor-evaporator with a centrifugal fan, compressor and other components and a lower compartment also having a condensor-evaporator and fan. As inside type heat pumps are often used in relatively small buildings, manufactured homes and the like, homeowners and others are often sensitive to noise and vibrations created by the fans which run frequently during extreme weather conditions. Also, in smaller homes, cost is of importance and two centrifugal type fans which are commonly used in inside type heat pumps can increase the manufacturers' production costs, add to the shipping and handling charges and inconvenience.

Therefore, with the known disadvantages of conventional inside type heat pumps, the present invention was conceived and one of its objectives is to provide an inside type of heat pump which utilizes an exhaust fan positioned exteriorly of the heat pump housing.

It is still another objective of the present invention to provide a heat pump and method whereby the exhaust air is directed from the upper heat pump housing upwardly through a fan positioned in the attic or on the roof of the building.

It is yet another objective of the present invention to provide a heat pump which is relatively easy to install and maintain.

It is also another objective of the present invention to provide an efficient heat pump which can be manufactured and transported at a relatively low price.

Various other objectives and advantages of the present invention become apparent to those skilled in the art as a more detailed presentation is set forth below.

SUMMARY OF THE INVENTION

The aforesaid and other objectives are realized by providing an inside type heat pump having an outer housing which is compartmentalized with upper and lower compartments. The upper compartment contains a condensor-evaporator which allows fresh air to pass therethrough and be exhausted through a fan conduit in communication with the upper compartment with a fan mounted exteriorly of the heat pump housing. The heat pump also includes a lower compartment having a condensor-evaporator and a centrifugal fan therein. The exhaust fan is mounted for example on the roof or in the attic, vertically above the heat pump. The exhaust fan may consists of a quarter horsepower 110 V AC electric motor with a four blade propeller attached to the motor shaft. Thus, in operation fresh air is directed through the condensor-evaporator in the upper compartment and is exhausted through the roof. The conditioned air for the building passes through the lower compartment and is returned to the condensor-evaporator contained therein by a centrifugal fan mounted in the lower compartment. Less noise and vibration and easier accessibility for service personnel provide advantages both to the manufacturer and consumer.

DESCRIPTION OF THE PREFERRED EMBODIMENT

Figure 1:
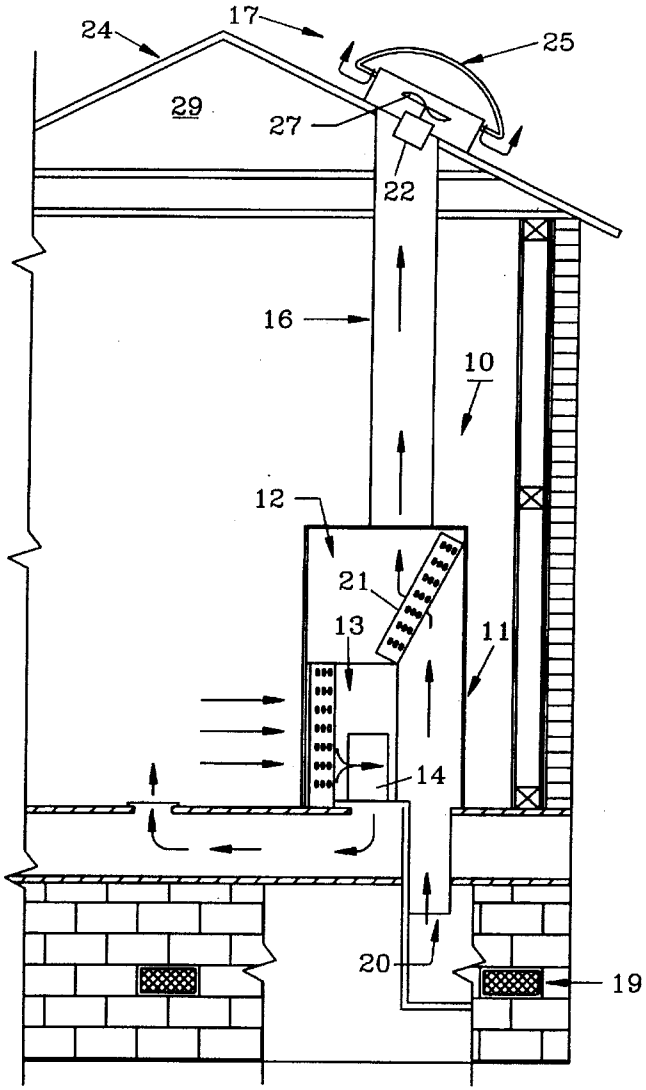
FIG. 1 demonstrates a typical one story house having an attic, crawl space and centralized living area with inside type heat pump positioned in the living area.

The preferred form of the invention and its method of operation can be illustrated by FIG. 1. An inside type heat pump is shown having an upper and lower compartment each of which house condensor-evaporator. The lower compartment includes a centrifugal fan whereas the upper compartment has a condensor-evaporator but without a fan. The exhaust fan which directs air through the upper compartment is mounted on the roof and consists of a fractional horsepower electric motor and a conventional propeller blade. A cover is placed on top of the fan to prevent damage from the elements. Such roof placement greatly decreases the noise and vibration which may occur during peak use seasons. As further shown in FIG. 1, fresh air enters the heat pump through a bottom opening located in the crawl space and the roof exhaust fan directs fresh air upwardly, through the heat pump upper condensor-evaporator and through an exhaust conduit joined in communication with the upper compartment to the roof fan. The lower compartment of the heat pump provides conditioned air for the building and includes a centrifugal fan. The roof fan may be rated at 1,800 cfm whereas the centrifugal fan may be rated at only 1,000 cfm. Thus, by placing the exhaust fan on the roof exteriorly of the heat pump housing, noise and vibration to the living area is reduced.

DETAILED DESCRIPTION OF THE DRAWINGS AND OPERATION OF THE INVENTION

Figure 2:
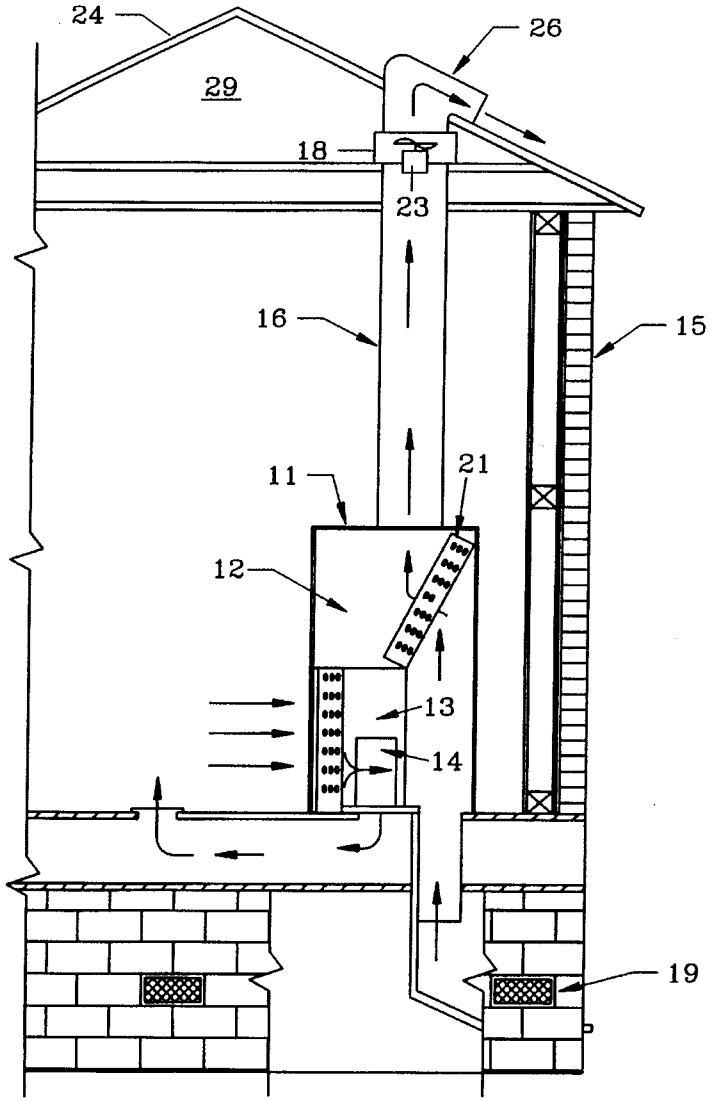
FIG. 2 illustrates the heat pump installation of FIG. 1 with the exhaust fan mounted in the attic.

For a better understanding of the drawings and method of operation, turning now to the drawings, heat pump 10 is shown in FIG. 1 which is of the "inside" type, i.e., having both two condensors-evaporators enclosed is a housing which is inside a building and without an external condensor-evaporator. Heat pump 10 include's housing 11 containing upper compartment 12 and second or lower compartment 13. While all the conventional heat pump operating components are not shown in FIGS. 1 and 2, heat pumps 10 seen in FIGS. 1 and 2, include centrifugal fan 14 which, in a typical manufactured or small "stick-built" house 15, may have a capacity of 1,000 cfm. In a typical "inside" heat pump, first or upper compartment 12 would contain a centrifugal fan having a capacity of approximately 1,800 cfm relative to fan 14 having a capacity of only approximately 1,000 cfm. However, in the present invention upper compartment 12 does not contain a centrifugal or other type fan in order to reduce noise, vibration and for the sake of economy and efficiency. Rather, heat pump 10 utilizes an exhaust conduit 16 as shown in FIGS. 1 and 2 which is in fluid communication with upper compartment 12 and a relatively lightweight, high cfm propeller blade roof mounted fan 17 or attic mounted propeller blade fan 18 (as shown in FIG. 2). As seen in FIG. 1, fresh air enters foundation vent 19, passes through blower housing opening 20, travels upwardly through heat pump housing 11, passes through upper compartment coil 21, and is then exhausted through linear conduit 16.

Exhaust fans 17 and 18 are conventional propeller type fans which are driven by a fractional horsepower motors, 22, 23 respectively. Heat pump 10 may be used in relatively small houses and as a result, the conventional internal fans can be somewhat noisey and disturbing to the occupants. Fan 14 is generally of lower capacity and in-and-of itself does not generally cause concern. However, a larger more powerful centrifugal fan mounted in upper compartment 12 can cause irritation and disturb activities of the homeowners, particularly during times of peak usage. Thus, the noise and vibration experienced can be greatly reduced by installing exhaust conduit 16 as shown herein.

In FIG. 1 exhaust fan 17 is mounted exteriorly of house 15 atop roof 24. Cover 25 protects fan 17 from rain, snow and the like and can be easily removed for service purposes. When service is required, exhaust fan 17 can be accessed by a service technican without entry into house 15. As seen in FIG. 1, fresh air moves through housing 11, past through coil 21 where it enters exhaust conduit 16 and exits beyond fan 17 above roof 24. In FIG. 2, attic fan 18 draws air from upper compartment 12, passed coil 21 through conduit 16, through fan 18 and upwardly through roof exhaust conduit 26.

By placing exhaust fan exterior of heat pump housing 11 a more economical heat pump can be manufactured which is lighter in weight, easy to handle and install without sacrificing efficiency. In addition the homeowner is pleased with the reduction in vibration and noise which occurs during peak operating seasons.

The illustrations and examples provided herein are for explanatory purposes and are not intended to limit the scope or provide all the advantages of the invention as set forth in the appended claims.

I claim:

1. A heat pump for heating and cooling of air within a building having a roof and a foundation, said heat pump being the interior, two compartment type wherein one compartment houses a condensor-evaporator which acts as a condensor during the cooling cycle and the other compartment housing a condensor-evaporator which acts as an evaporator during the cooling cycle, the improvement comprising: an exhaust conduit, said exhaust conduit in communication with said heat pump, an exhaust fan, said exhaust fan in fluid communication with said exhaust conduit, said exhaust fan positioned on said building roof whereby exhaust air will pass from said heat pump through said exhaust conduit.

2. The heat pump of claim 1 wherein said heat pump includes an intake conduit, said intake conduit in fluid communication with said foundation area.

3. The heat pump of claim 1 wherein said exhaust fan is positioned on top of said roof.

4. The heat pump of claim 1 wherein said exhaust fan is positioned vertically above said heat pump.

5. The heat pump of claim 1 wherein said exhaust conduit is linear.

6. The heat pump of claim 1 wherein said exhaust conduit is vertically positioned.

7. The heat pump of claim 1 wherein said exhaust fan comprises a propeller blade.

8. The heat pump of claim 1 wherein exhaust fan comprises a fractional horsepower electric motor.

9. A heat pump for heating and cooling an interior of a building, said building having a roof above and a foundation area below the interior, said heat pump of the interior, two compartment type with a housing located within the building wherein one compartment within the housing contains a condensor-evaporator which acts as a condensor during the cooling cycle and the other compartment within the housing acts as an evaporator during the cooling cycle, the improvement comprising: an exhaust conduit, said exhaust conduit in fluid communication with said heat pump housing, said exhaust conduit extending upward from said heat pump housing, an exhaust fan, said fan positioned externally above said roof and in fluid communication with said conduit whereby said exhaust fan will direct air from said heat pump upward through said conduit to the exterior above said roof, an intake conduit, said intake conduit in fluid communication with said heat pump housing, said intake conduit extending downward from said heat pump housing and in fluid communication with said foundation area.

10. The heat pump of claim 9 wherein said exhaust fan comprises the propeller blade type.

11. The heat pump of claim 9 wherein said exhaust fan is positioned on said roof.

12. The heat pump of claim 9 wherein said exhaust conduit is linear.

13. The method of exhausting air from an interior type heat pump located within a building and having first and second compartments wherein each of said compartment house a condensor-evaporator, said first compartment is in fluid communication with an exhaust fan mounted exteriorly above said building, the method comprising the steps of:

(a) passing interior conditioned air through said second of said compartments, (b) passing exterior air through the first of said compartments, and (c) exhausting said exterior air from said first compartment exteriorly above said building by said exhaust fan.

14. The method of claim 13 including the step of exhausting exterior air above said building with said exhaust fan wherein said exhaust fan is a roof exhaust fan.

15. The method of claim 13 wherein the step of passing exterior air through the first compartment includes the step of intaking said exterior air from below said building.

* * * * *